US005131420A

United States Patent [19]

Favret et al.

[11] Patent Number: 5,131,420

[45] Date of Patent: Jul. 21, 1992

[54] DISHWASHING MACHINE WITH A SINGLE-MOTOR PUMP UNIT

[75] Inventors: Ugo Favret; Gianni Santarossa; Sergio Tassotti, all of Pordenone, Italy

[73] Assignee: Zanussi Elettrodomestici S.p.A., Pordenone, Italy

[21] Appl. No.: 707,810

[22] Filed: May 30, 1991

[30] Foreign Application Priority Data

Jul. 12, 1990 [IT] Italy ..... 45741 A/90

[51] Int. Cl.[5] ..... A47L 15/22

[52] U.S. Cl. ..... 134/104.1; 134/111; 134/180; 415/56.4; 415/56.5; 415/58.4

[58] Field of Search ..... 415/52.1, 56.1, 56.4, 415/56.5, 198.1, 58.1, 58.4, 59.1, 171.1, 208.1, 211.2; 134/104.1, 111, 180; 417/326, 423.1

[56] References Cited

U.S. PATENT DOCUMENTS 2,019,143 10/1935 La Bour ..... 415/56.1

4,799,855 1/1989 Milocco et al. .

4,972,861 11/1990 Milocco et al. ..... 134/104.1

*Primary Examiner*—Edward K. Look

*Assistant Examiner*—Christopher M. Verdier

*Attorney, Agent, or Firm*—Wenderoth, Lind & Ponack

[57] ABSTRACT

A dishwashing machine has a single motor pump unit, including a circulating centrifugal pump and a peripheral outflow drain pump mounted on a common shaft of a reversible drive motor to alternately deliver a washing fluid to and drain fluid from the dishwashing machine. The two pumps are connected by openings in their respective pump chambers communicating with an annular chamber between the two pumps. The annular chamber has a vent fluidly connecting the chamber with a washing water circuit of the dishwashing machine. Preferably the annular chamber has an impeller therein mounted on the drive shaft of the motor, forming a further centrifugal pump with the annular chamber.

14 Claims, 2 Drawing Sheets

DISHWASHING MACHINE WITH A SINGLE-MOTOR PUMP UNIT

BACKGROUND OF THE INVENTION

1. Field of the Invention

The present invention relates to a dishwashing machine that has a single-motor pump unit for both circulation and discharge of a washing liquid in the dishwashing machine.

2. State of the Prior Art

U.S. Pat. No. 4,799,855 discloses a dishwashing machine that is provided with a pump unit that has both a water circulating pump and a water drain pump. The impellers of the water circulating pump and the water drain pump are both keyed on a common shaft that can be reversibly driven by a drive motor. The water circulating pump is operated in one direction of rotation, and the water drain pump is operated in the other direction of rotation. The circulating pump is a so-called "action" centrifugal pump, and the impeller of the drain pump is a peripheral outflow impeller. The two pumps are separated by a partition, the partition having a calibrated annular opening defined around a hub which is common to the impellers of both pumps.

The above type of pump unit reduces remarkably the total energy consumption, the vibrations and the hydraulic noise occurring during operation of the dishwashing machine. The annular opening in the partition between the two pumps, providing a connection between the washing water circuit and the drain water circuit of the dishwashing machine, advantageously enables water collected in both of the water circuits to be discharged during every discharge phase.

However, during the washing operation the annular opening providing a direct connection between the drain water circuit and the washing water circuit causes an undesirable agitation of dirt particles deposited at a position corresponding with the suction side of the drain pump. It is preferable, as is known, that the dirt particles be allowed to stagnate during washing operations in order to prevent the dirt particles deposited at the suction side of the drain pump from polluting the washing water.

Furthermore, it is noted that during washing operations the impeller of the drain pump rotates in a direction opposite to its normal direction of operation. As a result, the pump chamber of the drain pump tends to fill with air. Consequently, at the beginning of each subsequent drainage operation the drain pump is in a substantially poor priming condition. This has an undesirable effect on the performance of the drain pump.

SUMMARY OF THE INVENTION

The primary object according to the present invention is the provision of a dishwashing machine having a single-motor pump unit that is capable of automatically discharging water from both washing and drain water circuits without, during the washing operation, causing agitation of dirt particles that collect in the drain water circuit.

It is a further object of the present invention to provide a dishwashing machine having a pump unit according to the type discussed above wherein the priming condition of the drain pump is substantially unaffected by its reverse rotation during washing operations.

The above objects are achieved according to the present invention by the provision of a pump unit for a dishwashing machine which has a circulating centrifugal pump and a peripheral outflow drain pump mounted on a common shaft and driven by a reversible pump motor. The circulating centrifugal pump has a pump housing and a impeller mounted on the drive shaft for delivering a fluid in a washing water circuit. The peripheral outflow drain pump has a pump housing and an impeller mounted on the drive shaft as well, for draining the fluid from a drain water circuit. Each of the circulating pump and the drain pump has an opening in its respective housing for fluidly connecting the pumps to each other. An annular chamber is defined between the circulating pump and the drain pump, with the openings of the pumps both communicating with the annular chamber. A vent in the annular chamber communicates the annular chamber with the washing water circuit.

The annular chamber is defined by an annular housing connected to the housings of both pumps, and has the vent extending therethrough. Preferably, the annular chamber further has an impeller mounted on the drive shaft, thereby forming a centrifugal pump with the annular chamber. The impeller of the annular chamber is provided with radial blades on a side thereof facing toward the drain pump. In a further preferred feature, the annular chamber has a baffle disposed adjacent the vent for directing at least some of the fluid moved by the impeller of the annular chamber into the vent.

The annular chamber is coaxial with and adjacent to the circulating pump and the drain pump. Furthermore, the vent preferably comprises a vent pipe.

Note that the dishwashing machine comprises a wash tub, a water collecting sump in the wash tub at a lower portion thereof, a rotary spray arm rotatably mounted in the wash tub and the pump unit. A suction inlet of the centrifugal pump connects with the water collecting sump, and its outlet connects with the rotary spray arm for delivering the washing fluid thereto. The drain pump has a suction inlet connected with the wash tub and a drain outlet for removing the drain water from the wash tub.

During a washing phase, the circulating pump delivers water to the rotary spray arm. A small amount of water is caused to flow toward the drain pump through the annular openings connecting the two together. This amount of water might tend to enter the drain pump, rotating in a reverse direction, and cause agitation of dirt particles collected at the suction side of the drain pump. But by the provision of the vent in the annular chamber between the two pumps, water which flows through the opening toward the drain pump is substantially vented into the washing water circuit of the dishwashing machine before reaching the drain pump. This effect is further enhanced by the provision of the impeller in the annular chamber, as well as the baffle.

BRIEF DESCRIPTION OF THE DRAWINGS

Further objects, features and advantages of the present invention will be apparent to those of skill in the art from the following description of a preferred embodiment of the present invention, presented by way of example, with reference to the accompanying drawings, in which.

DETAILED DESCRIPTION OF THE PREFERRED EMBODIMENT

Figure 1:
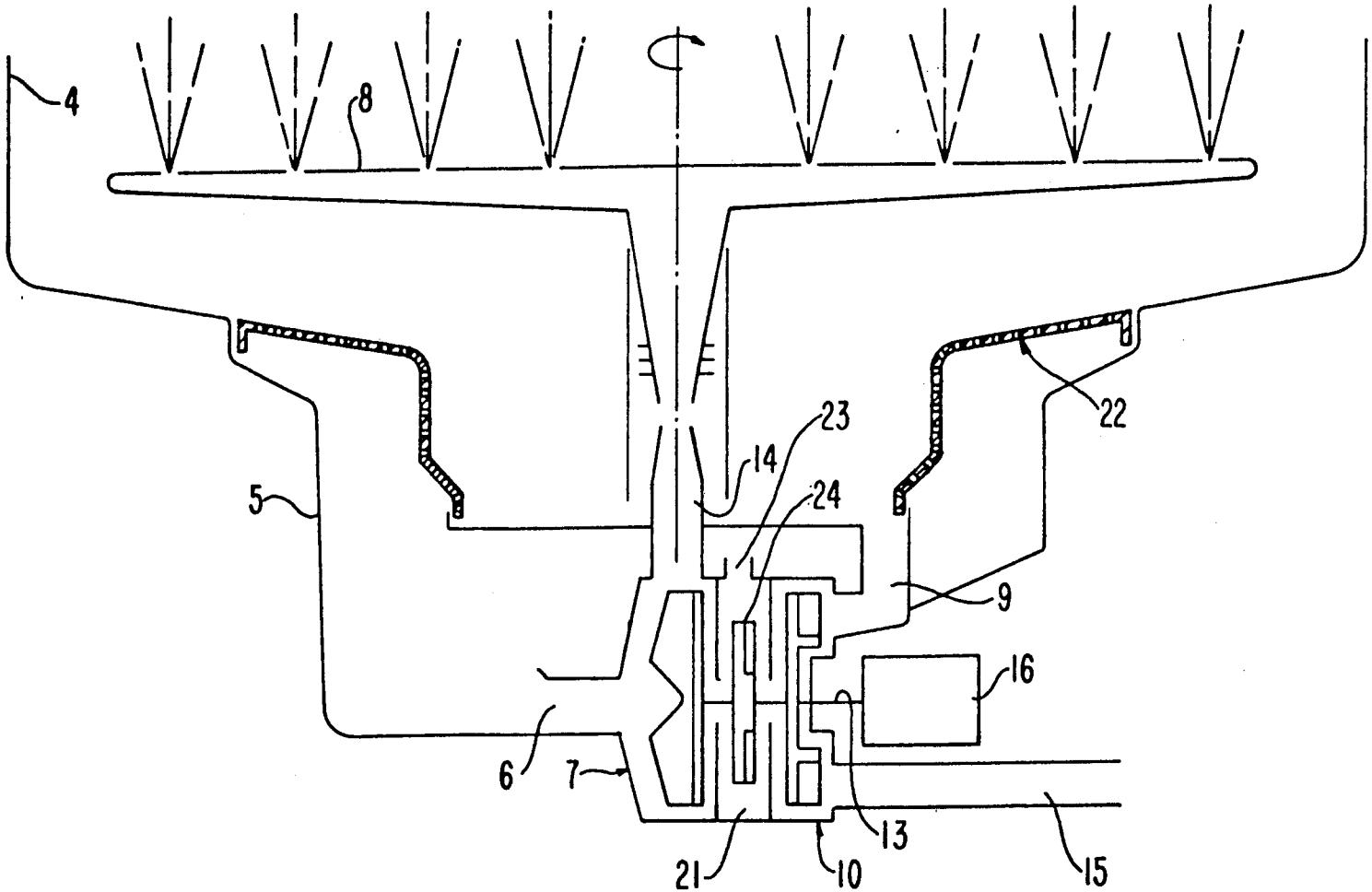
FIG. 1 is a diagrammatic illustration of the primary components of a dishwashing machine according to the present invention.

Referring initially to FIG. 1, the dishwashing machine according to the present invention includes a wash tub 4, shown partially in the figure. A filtering arrangement 22 is provided at the lower portion of the wash tub 4, and a water collecting sump 5 is provided at the bottom of the wash tub 4 below the filtering arrangement 22. A suction inlet 6 leads to a centrifugal circulating pump 7. The circulating pump 7 feeds water to a rotary spray arm 8 mounted inside the wash tub 4 for rotation for spraying dishes to be washed in a known manner. A further suction inlet 9 communicates with the wash tub 4 and leads to a drain pump 10 for draining water from the wash tub 4.

Figure 2:
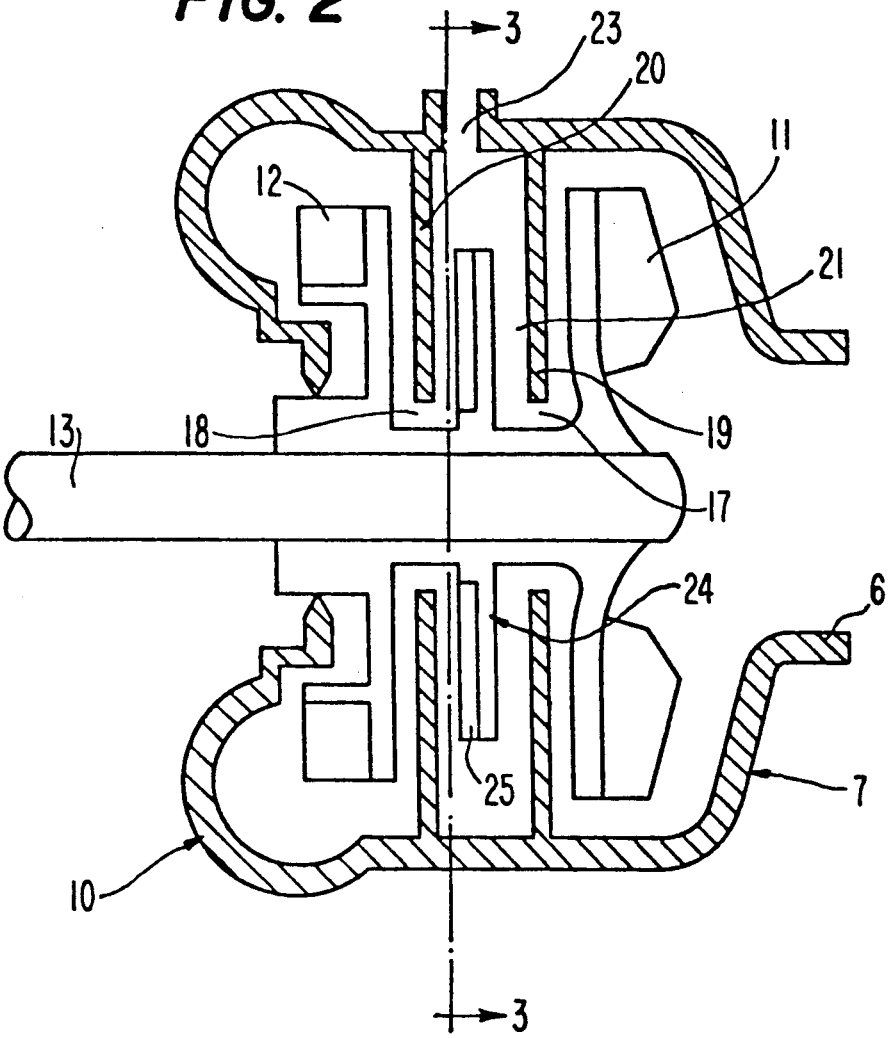
FIG. 2 is a schematic view of a longitudinal section of a preferred embodiment of a pump unit for the dishwashing machine of FIG. 1, presented on an enlarged scale with respect to FIG. 1.

Referring additionally to FIG. 2, the pumps 7 and 10 are provided with impellers 11 and 12, respectively. Both of the impellers are mounted (keyed) on a common shaft 13. Shaft 13 is connected to a reversible electric motor 16 to be rotatably driven thereby. In one direction of rotation, the circulating pump 7 suctions water from inlet 6 and delivers the water, or washing fluid, to a delivery outlet 14 providing the water to the rotary spray arm 8. When the motor 16 is driven in the opposite rotational direction, the drain pump 10 suctions water from its inlet 9 and delivers the water to a drain outlet 15. When the circulating pump 7 is delivering water to outlet 14, the drain pump 10 rotates together with the pump 7 but does not drain water from the wash tub 4. Likewise, when the drain pump 10 drains water from the wash tub 4, the circulating pump 7 does not deliver water to the delivery outlet 14.

Thus, either the circulating pump 7 or the drain pump 10 is alternately operated during a respective washing operation or a drainage operation when the drive shaft 13 is driven by the drive motor 16 in one rotational direction or the other.

The pumps 7 and 10 are arranged substantially as described in U.S. Pat. No. 4,799,855 as discussed above. This patent is incorporated herein by reference. Accordingly, the pumps form part of a single motor pump unit wherein the drain pump 10 is a peripheral outflow type of pump while the circulating pump 7 is a centrifugal pump having an impeller of the so-called action type, i.e. having blades oriented forwardly with respect to the operational direction of rotation for performing a dishwashing operation.

Furthermore, note that the circulating pump 7 and the drain pump 10 are mutually coaxial and mounted adjacent to each other. Each pump has walls which define a housing for the respective impellers, and thus a pump chamber through which the washing fluid flows. The pump chambers are defined by partitions 19 and 20 as seen in FIG. 2. These partitions have respective annular openings 17 and 1 surrounding the drive shaft 13. The annular openings communicate the respective pump chambers with each other.

The partitions 19 and 20 defining the pump chambers also define a substantially annular chamber 21 therebetween. The annular chamber 21 communicates with the circulating pump 7 and the drain pump 10 through the respective annular opening 17 and 18. The annular chamber 2 is further provided with a vent pipe 23 for venting the annular chamber to the washing water circuit of the dishwashing machine, as can be seen in FIG. 1. In particular, the vent pipe 23 opens into the area of the pump 5 defined between the filtering arrangement 22 and the suction inlet 6 of the circulating pump 7.

The vent pipe 23 preferably has a predetermined cross section and extends from an upper, or top, sidewall of the annular chamber 21.

The above-described pump unit provides advantages similar to those provided with the pump unit of U.S. Pat. No. 4,799,855, and operates in a substantially similar manner. However, during the washing operation the circulating pump 7 feeds a washing fluid to the rotary spray arm 8 with water suctioned from the sump 5. The circulating pump 7 itself causes a small amount of water to flow towards the drain pump !0 through the annular opening 17, the annular chamber 21 and the annular opening 18. This water, then, tends to enter into the pump chamber of the drain pump 10. The impeller 12, which during the washing operation is rotating in a reverse direction, tends to project this water toward the suction inlet 9 of the pump 10. This causes an undesirable agitation of dirt particles that collect at the suction inlet 9 of the drain pump 10. This drawback is minimized in the present invention by the provision of the vent pipe 23. The water flowing from the circulating pump 7 into the annular chamber 21 is substantially vented into the washing water circuit of the dishwashing machine before it has a chance to enter the drain pump 10 and disturb the dirt particles collected at the suction inlet 9.

Figure 3:
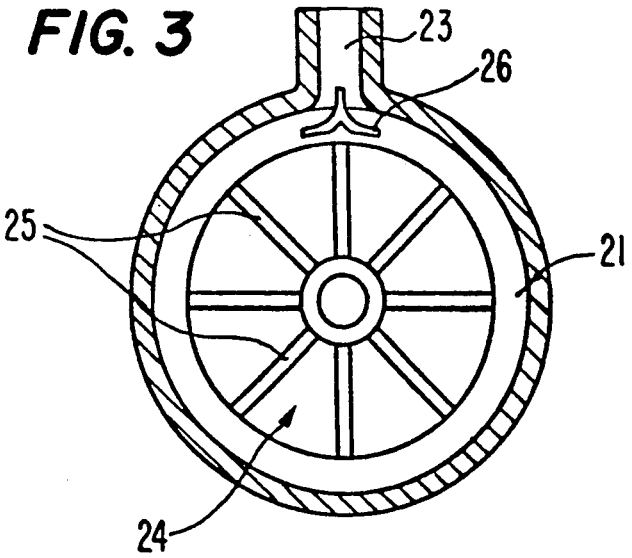
FIG. 3 is a cross-sectional view of the pump unit as illustrated in FIG. 2 taken along line 3-3.

As can be seen in FIGS. 1 and 2, a further improvement according to the present invention lies in the provision of an impeller 24 mounted on the drive shaft 13 inside the annular chamber 21. The impeller 24 is also illustrated in FIG. 3. As illustrated, the impeller 24 is preferably of a type, known per se, which has radial blades 25 forming a centrifugal pump together with the annular chamber 21. The blades 25 are preferably provided on the side of the impeller 24 which faces the drain pump 10.

During a washing operation, the impeller 24 provides an effective hydraulic barrier between the circulating pump 7 and the drain pump 10. The impeller 24 causes a centrifugally forced expulsion of water through the vent pipe 23 which otherwise might flow from the annular chamber 21 into the drain pump 10, as discussed above.

During the drainage operation, the circulating pump 7, which is rotating in a reverse direction, will still produce a water flow toward the annular chamber 21 and the vent pipe 23. This water flow has a reduced pressure, and is substantially negligible, not affecting the general performance of the pump unit. However, due to the reduced head of the circulating pump 7, during the drainage operation the impeller 24 in the annular chamber 21 will draw air that was trapped in the drain pump 10 during the washing operation into the annular chamber 21 and then vent the air through the vent pipe 23. This action by the impeller 24 primes the drain pump 10 and assures the proper operation of the drain pump.

In a further preferred feature of the present invention, FIG. 3 illustrates a baffle 26 provided in the annular chamber 21. The baffle 26 can take the form of an inverted Y or an inverted T, and is placed at a position corresponding to the opening or mouth of the vent pipe 23 on the sidewall of the annular chamber 21. The baffle 26 improves the flow of the fluid circulated inside the annular chamber 21 toward the vent pipe 23 when the impeller 24 is driven in either direction of rotation.

Although the present invention has been described and illustrated with respect to preferred features thereof, it is to be understood that various modifications and changes to the specifically described and illustrated features of the pump unit without departing from the scope of the present invention.

We claim:

1. A pump unit for a dishwashing machine, comprising:

a reversible pump driving motor having a drive shaft;

a circulating pump having a pump housing and an impeller mounted on said drive shaft for delivering a fluid in a washing water circuit;

a peripheral outflow drain pump having a pump housing and an impeller mounted on said drive shaft for draining the fluid from a drain water circuit;

each of said circulating pump and said drain pump having an opening in its respective said housing for fluidly connecting said pumps to each other;

an annular chamber defined between said circulating pump and said drain pump, said openings of said pumps both communicating with said annular chamber; and a vent in said annular chamber for communication with the washing water circuit.

2. The pump unit of claim 1 wherein said annular chamber is defined by an annular housing connected to said housings of said pumps and having said vent extending therethrough.

3. The pump unit of claim 2, wherein said annular chamber further has an impeller mounted on said drive shaft, thereby forming a centrifugal pump with said annular chamber.

4. The pump unit of claim 3, wherein said impeller of said annular chamber has radial blades on a side thereof facing said drain pump.

5. The pump unit of claim 3, wherein said annular chamber has a baffle means therein disposed adjacent said vent for directing at least some of the fluid moved by said impeller of said annular chamber into said vent.

6. The pump unit of claim 1, wherein said annular chamber is coaxial with and adjacent to said circulating pump and said drain pump.

7. The pump unit of claim 1, wherein said vent comprises a vent pipe.

8. A dishwashing machine, comprising:

a wash tub;

a water collecting sump in said wash tub at a lower portion thereof;

a rotary spray arm rotatably mounted in said wash tub; and a pump unit, said pump unit comprising:

a reversible pump driving motor having a drive shaft, a circulating pump having a pump housing, an impeller mounted on said drive shaft, a suction inlet connecting with said water collecting sump, and an outlet connecting with said rotary spray arm for delivering a washing fluid thereto, a peripheral outflow drain pump having a pump housing, an impeller mounted on said drive shaft, a suction inlet connecting with said wash tub and a drain outlet;

each of said circulating pump and said drain pump having an opening in its respective said housing for fluidly connecting said pumps to each other, an annular chamber defined between said circulating pump and said drain pump, said openings of said pumps both communicating with said annular chamber, and a vent in said annular chamber communicating with said wash tub.

9. The pump unit of claim 8, wherein said annular chamber is defined by an annular housing connected to said housings of said pumps and having said vent extending therethrough.

10. The pump unit of claim 9, wherein said annular chamber further has an impeller mounted on said drive shaft thereby forming a centrifugal pump with said annular chamber.

11. The pump unit of claim 10, wherein said impeller of said annular chamber has radial blades on a side thereof facing said drain pump.

12. The pump unit of claim 10, wherein said annular chamber has a baffle means therein disposed adjacent said vent for directing at least some of the fluid moved by said impeller of said annular chamber into said vent.

13. The pump unit of claim 8, wherein said annular chamber is coaxial with and adjacent to said circulating pump and said drain pump.

14. The pump unit of claim 8, wherein said vent comprises a vent pipe.

* * * * *